US010952568B2

(12) United States Patent
Matthews

(10) Patent No.: US 10,952,568 B2
(45) Date of Patent: Mar. 23, 2021

(54) WEARABLE SANITIZER DISPENSER

(71) Applicant: SANIBEADS, LLC, San Clemente, CA (US)

(72) Inventor: Kimberly Kirby Matthews, San Clemente, CA (US)

( * ) Notice: Subject to any disclaimer, the term of this patent is extended or adjusted under 35 U.S.C. 154(b) by 0 days.

(21) Appl. No.: 16/789,312

(22) Filed: Feb. 12, 2020

(65) Prior Publication Data

US 2020/0260917 A1 Aug. 20, 2020

Related U.S. Application Data

(60) Provisional application No. 62/807,144, filed on Feb. 18, 2019.

(51) Int. Cl.

| | |
|---|---|
| ***A47K 5/12*** | (2006.01) |
| ***A45F 5/00*** | (2006.01) |
| ***A47K 5/122*** | (2006.01) |
| ***A44C 5/00*** | (2006.01) |

(52) U.S. Cl.

CPC ..... *A47K 5/1201* (2013.01); *A44C 5/003* (2013.01); *A45F 5/00* (2013.01); *A47K 5/122* (2013.01); *A45F 2005/008* (2013.01)

(58) Field of Classification Search

CPC ..... A47K 5/1201; A47K 5/122; A44C 5/003; A44C 5/0023; A47F 2005/008; B05B 7/1413; A61M 35/00; A61M 35/003

USPC ..... 222/175

See application file for complete search history.

(56) References Cited

U.S. PATENT DOCUMENTS

| | | | | |
|---|---|---|---|---|
| 2,713,543 | A * | 7/1955 | Peters | B65D 77/30 426/116 |
| 5,957,347 | A * | 9/1999 | White | A45F 3/20 222/175 |
| 6,126,041 | A * | 10/2000 | DiTomasso | A45F 3/20 222/175 |
| 6,173,866 | B1 | 1/2001 | Taylor, Jr. et al. | |
| 7,316,332 | B2 * | 1/2008 | Powers | A45D 34/00 222/1 |
| 8,082,753 | B1 * | 12/2011 | Alvarez, Jr. | A45F 3/16 63/1.14 |
| D672,465 | S * | 12/2012 | Sherman | D24/207 |
| 8,950,632 | B2 | 2/2015 | Ciavarella et al. | |
| 8,973,788 | B1 | 3/2015 | Burns | |
| 9,932,133 | B2 * | 4/2018 | Sherman | A44C 15/00 |
| 10,413,025 | B1 * | 9/2019 | Cwalinski | A44C 15/005 |
| 2004/0016774 | A1 * | 1/2004 | Gentzkow | A61J 7/0046 222/175 |
| 2006/0078484 | A1 | 4/2006 | Greep | |
| 2006/0091156 | A1 * | 5/2006 | Powers | A45D 34/00 222/175 |

(Continued)

*Primary Examiner* — Benjamin R Shaw

(74) *Attorney, Agent, or Firm* — Lewis Brisbois Bisgaard Smith

(57) ABSTRACT

An apparatus for a wearable sanitizer dispenser that comprises elastic elements filled with liquid sanitizer. Each elastic element is for storing, transporting and dispensing sanitizer. The elastic element has a slit on its surface. The release of liquid sanitizer stored in the elastic element is prompted by compressing the elastic element and squeezing liquid sanitizer through the slit. The slit is also used for inserting liquid sanitizer into the elastic element. Multiple elastic elements can be strung together through the tube and worn as a bracelet or necklace.

6 Claims, 3 Drawing Sheets

(56) References Cited

U.S. PATENT DOCUMENTS

| | | | | |
|---|---|---|---|---|
| 2008/0193495 | A1 | 8/2008 | Kharazmi | |
| 2008/0230560 | A1* | 9/2008 | Powers | A45D 34/00 222/175 |
| 2011/0139823 | A1* | 6/2011 | Staudt | A41D 20/00 222/175 |
| 2011/0155765 | A1* | 6/2011 | Properzi | A47K 5/1201 222/175 |
| 2012/0282011 | A1 | 11/2012 | Francois | |
| 2013/0292414 | A1* | 11/2013 | Sutherland | A47K 5/1201 222/107 |
| 2016/0044997 | A1* | 2/2016 | Horgan | A45F 5/00 222/175 |
| 2017/0156454 | A1 | 6/2017 | Elias Abadi | |
| 2018/0071466 | A1* | 3/2018 | White | A44C 5/003 |

* cited by examiner

WEARABLE SANITIZER DISPENSER

CROSS-REFERENCE TO RELATED APPLICATION

This application claims the benefit of and priority from U.S. provisional application No. 62/807,144 filed on Feb. 18, 2019 and entitled WEARABLE SANITIZER DISPENSER. The contents of the above application are hereby incorporated herein by reference in full.

FIELD OF INVENTION

This specification relates to a system for transporting, storing, and dispensing sanitizer as a wearable apparatus.

BACKGROUND

The presently described invention provides a convenient and discreet way to apply sanitizer directly onto the user's hand in a situation where using sanitizer may not be deemed appropriate, for instance, in business and social occasions where cleaning the user's hand immediately after a handshake may be considered impolite and inappropriate. It would be desirable to have a sanitizer dispenser that allows the user to dispense sanitizer in a more discreet way. Further, it would be desirable to have a wearable sanitizer dispenser, for example, in a bracelet form on a wrist, to enable direct application of sanitizer onto the user's hand.

SUMMARY

The objective is to provide a sanitizer dispenser that is wearable and quickly dispenses liquid sanitizer directly onto the user's hand.

The objective is to provide a sanitizer dispenser that is refillable.

The present invention is a sanitizer dispenser. It dispenses sanitizer by compressing an elastic element containing liquid sanitizer to release said sanitizer through an opening of the elastic element. One embodiment of the present invention may be in a form of an attachment to lanyards, strings, or laces. One preferred embodiment of the present invention is a bracelet comprising multiple wearable elastic elements containing liquid sanitizer. A wearable elastic element is a hollow sphere, comprises a tube encased substantially in the center of the elastic element, creating two openings that are substantially opposite to each other; and a slit on the surface for releasing liquid sanitizer and inserting said sanitizer into the elastic element. The elastic element is preferably made of silicone polymer.

DESCRIPTION OF THE PREFERRED EMBODIMENT

The detailed description of exemplary embodiments herein makes reference to the accompanying drawings and figures, which show the exemplary embodiments by way of illustration and best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. Moreover, any reference to singular includes plural embodiments, and any reference to more than one component may include a singular embodiment.

Figure 1:
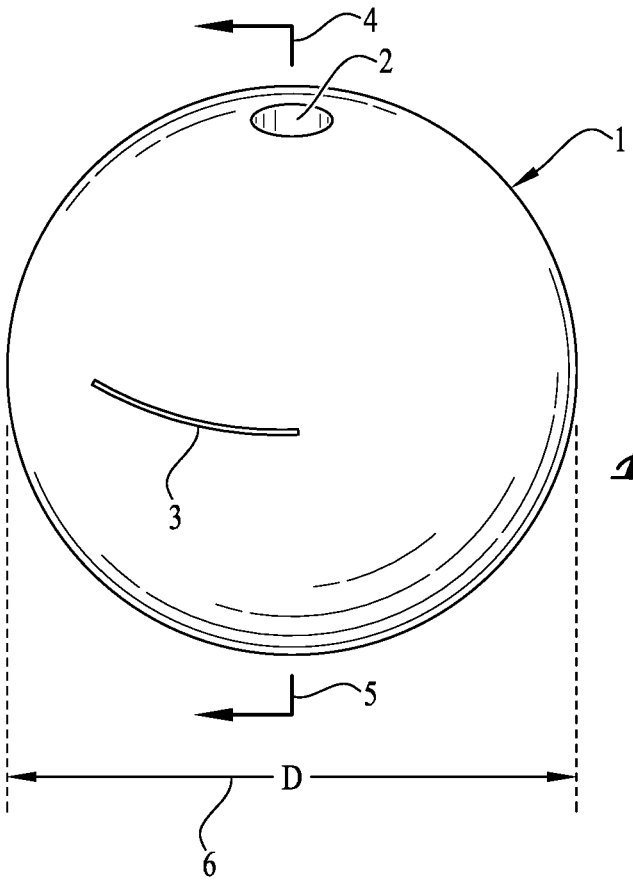
FIG. 1 is a perspective view of an embodiment of the present invention.

Referring to FIG. 1, there is disclosed a perspective view of an embodiment of the present invention. An elastic element 1 is a hollow sphere. The diameter of the elastic element 6 is preferably between 14 mm and 16 mm. The elastic element 1 is preferably made of silicone polymer. The elastic element 1 comprises a tube 2, encased substantially in the center of the elastic element 1, creating two openings 4 and 5, preferably between 1 and 4 mm in diameter of the tube 2, that are substantially opposite to each other; and a slit 3, preferably between 4 and 6 mm in length, that is positioned on circumference of the elastic element 1. The length of the tube 2 is substantially the same as the diameter of the elastic element 6.

The tube 2 need not be cylindrically shaped. The tube 2 can be a channel that allows a string or thread to pass through from one opening 4 and the other opening 5, or vice versa. The openings 4 and 5 are not necessarily circular.

Figure 2:
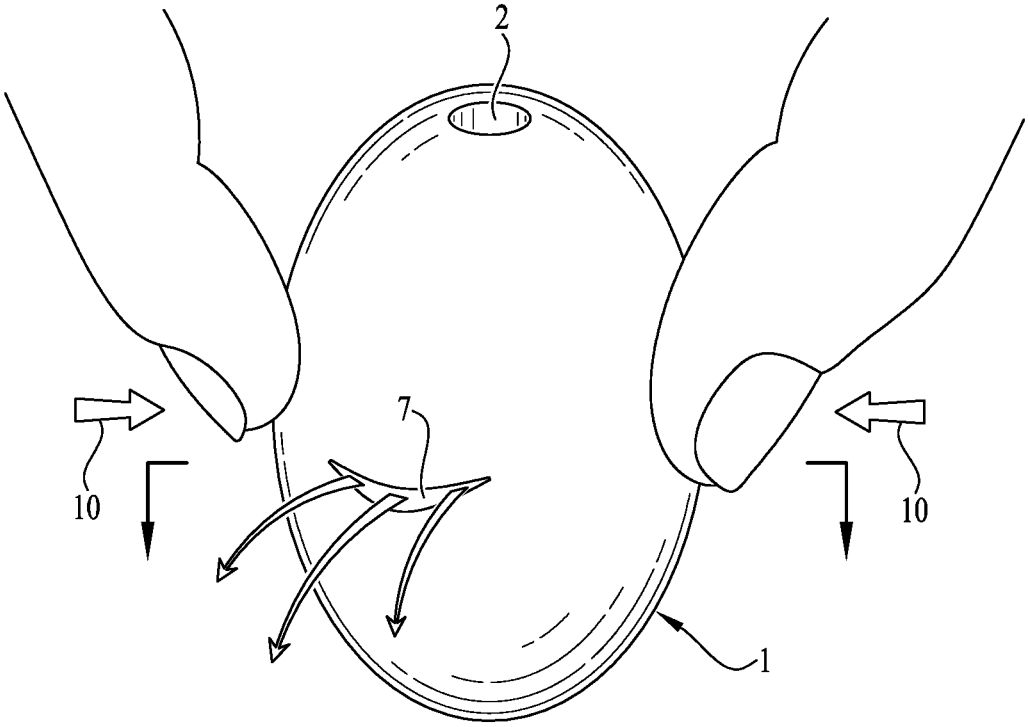
FIG. 2 is another perspective view of an embodiment of the present invention.

Referring to FIG. 2, there is disclosed another perspective view of an embodiment of the present invention containing liquid sanitizer, when deformed 10 releases liquid sanitizer through the slit 7.

Figure 3:
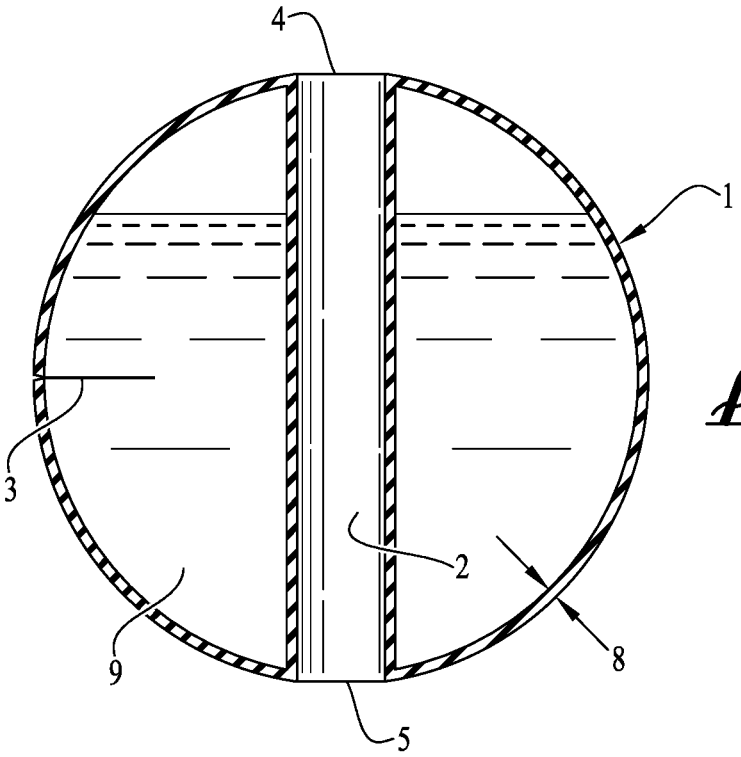
FIG. 3 is a sectional view, containing sanitizer, of an embodiment of the present invention.

Referring to FIG. 3, there is disclosed a cross sectional view of an embodiment of the present invention. The tube 2 is used for stringing multiple elastic elements together. A string or thread can pass through from one opening 4 to the other opening 5. The release of liquid sanitizer 9 is controlled by the slit 3 that is substantially sealed hermetically when no pressure is applied to the elastic element 1. The thickness of elastic element 8 is approximately 1 mm.

Figure 4:
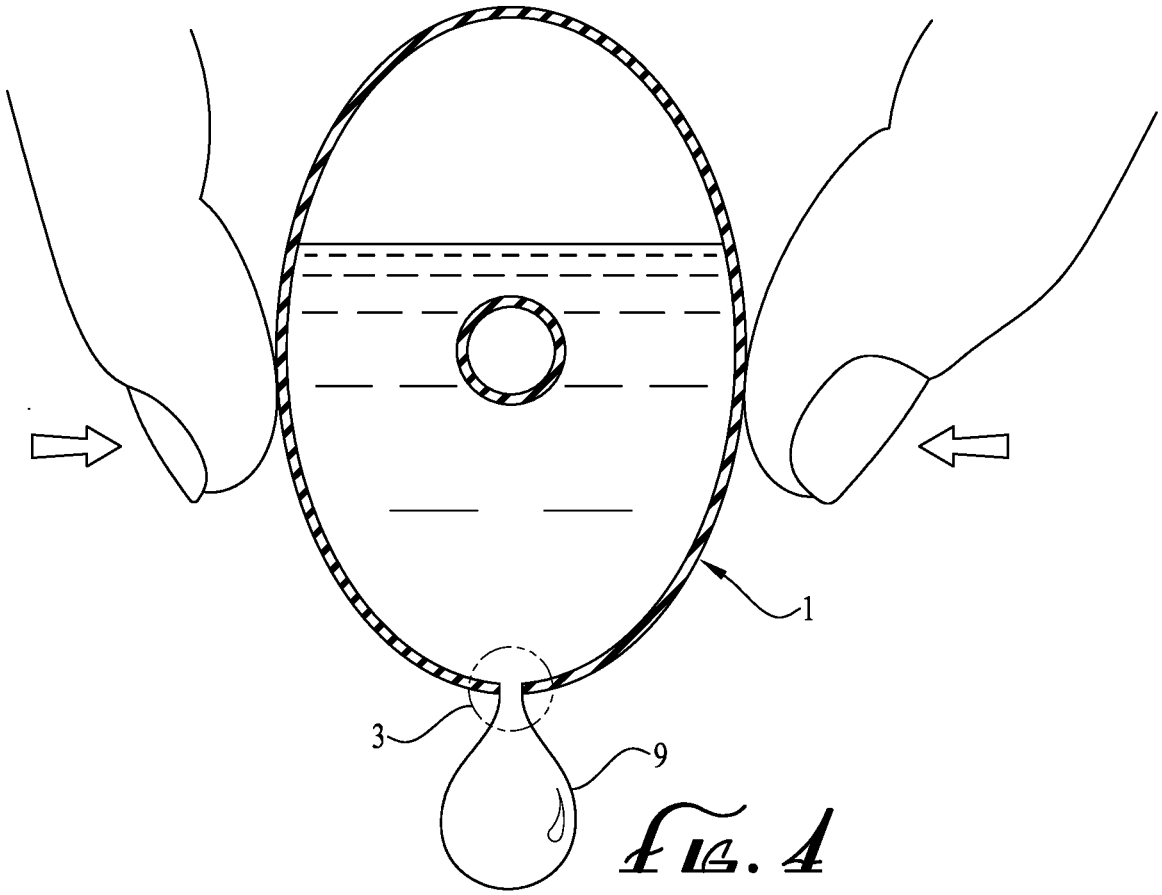
FIG. 4 is a top plan view of an embodiment of the present invention.

Referring to FIG. 4, there is disclosed a top view of an embodiment of the present invention when the user applies pressure to the elastic element 1, resulting in releasing of liquid sanitizer 9 through the slit 3. Said elastic element 1 can hold and dispense approximately 0.0235 fluid ounce of liquid sanitizer 9.

Figure 5:
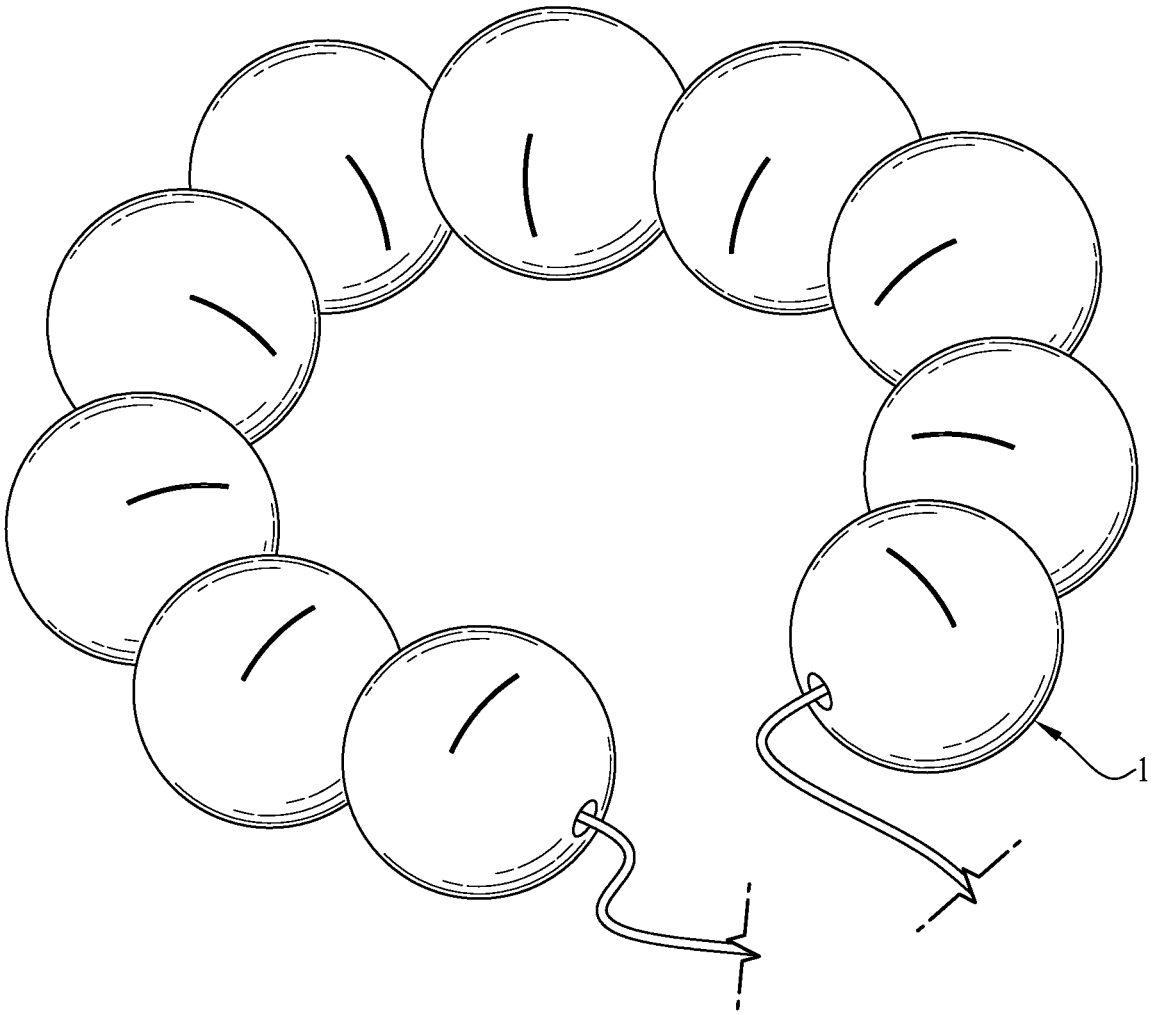
FIG. 5 is a perspective view of an embodiment of the present invention in an example configuration.

Referring to FIG. 5, there is disclosed another embodiment of an embodiment of the present invention in a form of a bracelet, sanitizer saturated elastic elements are strung together. The diameter of the elastic element 1 is approximately 14 mm. The bracelet may comprise 14 to 16 elastic elements. The bracelet may be worn on a user's wrist.

The previous description of the disclosed examples is provided to enable any person of ordinary skill in the art to make or use the disclosed apparatus. Various modifications to these examples will be readily apparent to those skilled in the art, and the principles defined herein may be applied to other examples without departing from the spirit or scope of the disclosed apparatus. For example, the wearable sanitizer dispenser may be in other geometrical forms other than sphere, such as oval or cube. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus.

What is claimed is:

1. A wearable sanitizer dispenser comprising:

a wearable and reusable elastic element with a tube enclosed in the wearable and reusable elastic element and a slit opening on the wearable and reusable elastic element wherein the slit opening is substantially hermetically sealed when the wearable and reusable elastic element is undeformed, and the slit opening opens to allow for dispensing liquid sanitizer stored in the wearable and reusable elastic element when said wearable and reusable elastic element is deformed under pressure.

2. The wearable sanitizer dispenser of claim 1, wherein the wearable and reusable elastic element is a hollow sphere.

3. The wearable sanitizer dispenser of claim 1, wherein the tube enclosed substantially in the center of the wearable and reusable elastic element and creates two openings that are substantially opposite to each other.

4. The wearable sanitizer dispenser of claim 3, wherein the slit opening is located on circumference of the wearable and reusable elastic element, and the slit opening is located between the two openings.

5. The wearable sanitizer dispenser of claim 1, wherein the tube allows for stringing multiple wearable and reusable elastic elements together.

6. The wearable sanitizer dispenser of claim 1, wherein the slit opening allows for inserting liquid sanitizer into the wearable and reusable elastic element.

* * * * *